US011846482B2

(12) United States Patent
Freeman

(10) Patent No.: US 11,846,482 B2
(45) Date of Patent: Dec. 19, 2023

(54) EJECTION PORT COVER WITH MULTIFUNCTIONAL PIN

(71) Applicant: Magpul Industries Corp., Austin, TX (US)

(72) Inventor: Zachary Freeman, Broomfield, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 17/857,770

(22) Filed: Jul. 5, 2022

(65) Prior Publication Data

US 2023/0003481 A1 Jan. 5, 2023

Related U.S. Application Data

(60) Provisional application No. 63/218,088, filed on Jul. 2, 2021.

(51) Int. Cl.
*F41A 35/02* (2006.01)
*F41A 15/00* (2006.01)

(52) U.S. Cl.
CPC ..... *F41A 35/02* (2013.01); *F41A 15/00* (2013.01)

(58) Field of Classification Search
CPC ..... F41A 35/02
USPC ..... 42/83, 85, 96, 106
See application file for complete search history.

(56) References Cited

U.S. PATENT DOCUMENTS

| | | | | |
|---|---|---|---|---|
| 6,070,293 | A * | 6/2000 | Schreiber | E05D 7/1011 16/229 |
| 7,181,881 | B2 | 2/2007 | Fischbach et al. | |
| 7,493,720 | B1 | 2/2009 | Householder | |
| 7,819,052 | B2 | 10/2010 | Zedrosser | |
| 8,272,101 | B2 * | 9/2012 | Wagner | E05D 3/12 16/365 |
| 8,640,372 | B2 | 2/2014 | Hochstrate et al. | |
| 9,086,247 | B2 | 7/2015 | Lessard | |
| 9,188,405 | B2 | 11/2015 | Hawley | |
| 9,395,131 | B1 | 7/2016 | Clark | |
| 9,488,430 | B2 | 11/2016 | Hawley | |
| 9,612,075 | B1 | 4/2017 | Stephens, IV | |
| 9,970,728 | B1 | 5/2018 | Huang | |
| 10,309,746 | B1 | 6/2019 | Huang | |

(Continued)

FOREIGN PATENT DOCUMENTS

EP 0055690 A1 * 7/1982 ..... F41A 35/02

OTHER PUBLICATIONS

"Brownells—AR15: Installing the Ejection Port Cover", Youtube, 3 pages, Online available at <https://www.youtube.com/watch?v=bCFKTw4eA3o> and retrieved on: Sep. 6, 2022.

(Continued)

*Primary Examiner* — Bret Hayes
(74) *Attorney, Agent, or Firm* — Neugeboren O'Dowd PC

(57) ABSTRACT

Systems, methods, and apparatus for an ejection port cover with a multifunctional pin. In one embodiment, a fixed pin and a spring-loaded pin both mate with hinge openings at ends of the ejection port. The spring-loaded pin can be longitudinally biased by a spring, such as a torsion spring. This same spring can perform biasing of the ejection port cover toward an open position as well as biasing of a flag extending from the spring-loaded pin into a locked position when the ejection port cover is not installed.

21 Claims, 13 Drawing Sheets

(56) References Cited

U.S. PATENT DOCUMENTS

| | | | |
|---|---|---|---|
| 10,393,467 | B1 | 8/2019 | Ding et al. |
| D888,869 | S | 6/2020 | Chin |
| 11,085,727 | B2 | 8/2021 | Jen |
| 11,359,880 | B2 | 6/2022 | Nolte |
| 2005/0016051 | A1 | 1/2005 | Fischbach et al. |

OTHER PUBLICATIONS

"CMMG—AR-15 Ejection Port Cover", Brownells, 1 page, Online available at <https://www.brownells.com/rifle-parts/receiver-parts/ejection-port-cover-parts/ejection-port-covers/ar-15-ejection-port-cover-sku100044595-135717-248037.aspx> and retrieved on: Sep. 6, 2022.

"Ejection Port Cover Replacement", Youtube, 4 pages, Online available at <https://www.youtube.com/watch?v=qTOnBN5HxPY> and retrieved on: Sep. 6, 2022.

"HK416, MR556 Ejection Port Cover—German HK", HKParts, 3 pages, Online available at <https://hkparts.net/product/hk416-mr556-ejection-port-cover-german-hk> and retrieved on: Sep. 6, 2022.

"PolyFlex Dust Cover for 223/5.56", Strike Industries, 4 pages, Online available at <https://www.strikeindustries.com/si-polyflex-dc-223.html> and retrieved on: Sep. 6, 2022.

"Polymer AR-15 Ejection Port Cover Kit—Black", KAK, 4 pages, Online available at <https://www.kakindustry.com/ar15-ejection-port-cover-kit-polymer-black> and retrieved on: Sep. 6, 2022.

"Ultimate Dust Cover for _223/5.56", Strike Industries, 4 pages, Online available at <https://www.strikeindustries.com/si-ar-udc-e.html> and retrieved on: Sep. 6, 2022.

"UTG® Quick Install Dust Cover, Matte Black, 223/5.56", Leapers, Inc., 2 pages, Online available at <https://leapers.com/index.php?act=prod_detail&itemno=RBT-TKSDC> and retrieved on: Sep. 6, 2022.

* cited by examiner

OPEN STATE

1100

EJECTION PORT COVER WITH MULTIFUNCTIONAL PIN

CLAIM OF PRIORITY UNDER 35 U.S.C. § 119

The present Application for Patent claims priority to Provisional Application No. 63/218,088 entitled "EJECTION PORT COVER WITH MULTIFUNCTIONAL PIN" filed Jul. 2, 2021, and assigned to the assignee hereof and hereby expressly incorporated by reference herein.

FIELD OF THE DISCLOSURE

The present disclosure relates generally to firearms. In particular, but not by way of limitation, the present disclosure relates to systems, methods and apparatuses for an ejection port of a firearm.

DESCRIPTION OF RELATED ART

Military arms are exposed to harsh environments where dirt and debris can enter sensitive weapon mechanisms causing stoppages and malfunctions. To mitigate this issue, the AR-15 features a selectively employable cover to protect the large ejection port opening when it is not being fired. The standard ejection port cover assembly is composed of a stamped steel cover plate, rod, C-clip and torsion spring. While these parts come assembled onto a complete weapon from the factory, those assembling their own weapon or looking to upgrade their weapon with aftermarket parts may experience difficulties during removal or installation. Additionally, the standard cover can experience some performance issues depending on tolerances, abuse and environmental debris. Prior to the addition of the forward assist mechanism, the rod that mounts the cover could simply be pushed out the rear once the C-clip is removed. Depending on tolerancing, sometimes that is not possible with modern upper receivers that include this common feature. If disassembly from the front is required, the barrel assembly must be removed which requires specialized tools. Additional issues arise from the C-clip itself which is used to retain the rod. This part is especially small, can be difficult to handle for installation/removal and can be dislodged and easily lost during use. The torsion spring that powers the cover can sometimes cause issues if it is out-of-tolerance or tolerance stack issues arise. This can allow the short spring arm that normally sits against the receiver to slip past it. When this happens, the cover loses its spring pressure and then flops around when it is in the open position. Installation of the cover also requires pre-loading of the spring, which can be troublesome as the spring is small and difficult to manipulate without a tool. In most cases, this pre-loading has to be performed while also installing a detent or rod. Removal of the dust cover sometimes involves compression of this small spring, which may only be possible via a fingernail or a tool (e.g., see UTG Quick Install Dust Cover by LEAPERS). The steel cover plate typically works well but as a thin metal stamping, it can sustain detrimental deformation in use which can affect how well it remains closed and how well it functions to seal the ejection port. Finally, the detent mechanism that retains the cover in the closed position is permanently installed into the steel cover plate. While this is not typically a problem, it can make a detailed cleaning difficult if grit gets into the system and painting or refinishing the plate would have to be done in the "as assembled" state for those trying to upgrade the weapon.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some embodiments of the disclosure may be characterized as an ejection port cover assembly including an ejection port cover, a fixed pin, a spring-loaded pin, a user interface surface, and a torsion spring. The fixed pin can be configured to rotate within a first hinge opening of a firearm receiver portion. The spring-loaded pin can be configured to rotate within and selectively engage with a second hinge opening of the firearm receiver portion. The user interface surface can extend radially outward from the spring-loaded pin. The torsion spring can be configured to apply a torsional bias to the user interface surface and to bias the spring-loaded pin away from the fixed pin along a common axis, and wherein when installed on the firearm receiver portion, the torsion spring in combination with the user interface surface biases the ejection port cover toward an open position.

Other embodiments of the disclosure may also be characterized as a firearm including a receiver portion and an ejection port cover, the cover including a fixed pin and a spring-loaded pin. The receiver portion can include an ejection port, a first hinged opening, and a second hinged opening. The first hinged opening is at a first end of the ejection port and the second hinged opening is at a second end of the ejection port, such that the hinged openings bookend the ejection port. The fixed pin selectively mates with the first hinged opening and the spring-loaded pin selectively mates with the second hinge opening. The spring-loaded pin is configured for removal from the second hinge opening while the fixed pin is mated with the first hinge opening, thereby enabling tool-less removal of the ejection port cover from the receiver portion.

Other embodiment of the disclosure may further be characterized as a firearm ejection port cover assembly including an ejection port cover, a fixed pin, a spring-loaded pin, a spring, and a pin extension. The fixed pin can be configured for selective mating with a first hinge opening of a firearm receiver portion. The spring-loaded pin can be configured for selective mating with a second hinge opening of the firearm receiver portion, wherein the spring-loaded pin is configured for removal from the second hinge opening while the fixed pin is mated with the first hinge opening, thereby enabling tool-less removal of the ejection port cover from the firearm receiver portion. The spring can be engaged with the spring-loaded pin, for instance, being wrapped around the spring-loaded pin. The pin extension can extend from the spring-loaded pin engaged with the spring and configured to (1) bias the ejection port cover into an open position and (2) be used in removing the spring-loaded pin from the second hinge opening.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

Figure 1:
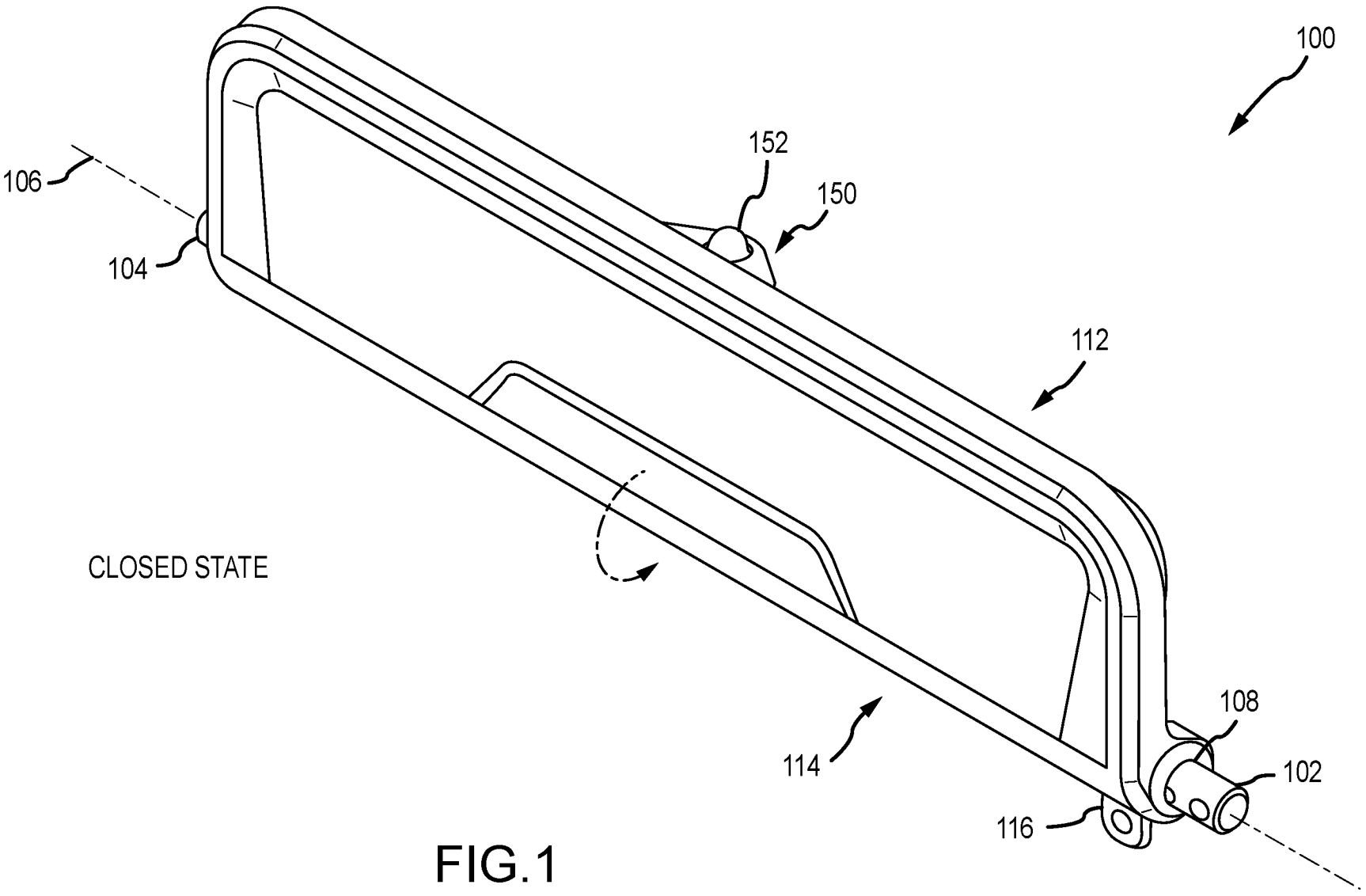
FIG. 1 illustrates an embodiment of an exterior of an ejection port cover.

The present disclosure relates generally to an ejection port cover. More specifically, but without limitation, the present disclosure relates to an ejection port cover for an AR-15-style firearm that can be installed and removed without tools.

Prior to describing the embodiments in detail, it is expedient to define terms as used in this document. For the purpose of this document, relational terms such as, without limitation, "longitudinal", "perpendicular", and "parallel" shall be understood to mean "within reasonable manufacturing tolerances accepted in the firearms manufacturing industry. The term "longitudinal" shall reference a direction of travel parallel with a longitudinal axis through an object/structure. For example, in FIG. 1, axis 106 is a longitudinal axis through the fixed and spring-loaded pins. The term "fore" shall reference that side or direction associated with a firing direction or a nose of a cartridge or the barrel of the firearm, while the term "aft" shall reference that side or direction associated with a rear stock, away from a firing direction. For example, in FIG. 1, the left of the page illustrates the aft region of the ejection port cover 100, and the right side of the page illustrates the fore region of the ejection port cover 100.

The word "exemplary" is used herein to mean "serving as an example, instance, or illustration." Any embodiment described herein as "exemplary" is not necessarily to be construed as preferred or advantageous over other embodiments.

Preliminary note: the flowcharts and block diagrams in the following Figures illustrate the functionality and operation of possible implementations of a selector lever according to various embodiments of the present disclosure. It should be noted that, in some alternative implementations, the functions noted in each block may occur out of the order noted in the figures. For example, two blocks shown in succession may, in fact, be executed substantially concurrently, or the blocks may sometimes be executed in the reverse order, depending upon the functionality involved.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, components, and/or groups, but do not preclude the presence or addition of one or more other features, integers, steps, operations, elements, components, and/or groups thereof. As used herein, the term "and/or" includes any and all combinations of one or more of the associated listed items, and may be abbreviated as "/".

Embodiments of the disclosure are described herein with reference to illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing. Accordingly, the regions illustrated in the figures are schematic in nature and their shapes are not intended to illustrate the actual shape of a region of a device and are not intended to limit the scope of the disclosure.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

For the purposes of this disclosure, the ejection port cover has an inside surface or face and an outside surface or face, as referenced when the ejection port cover is closed.

Tool-Less Tri-Function Spring

Figure 11:
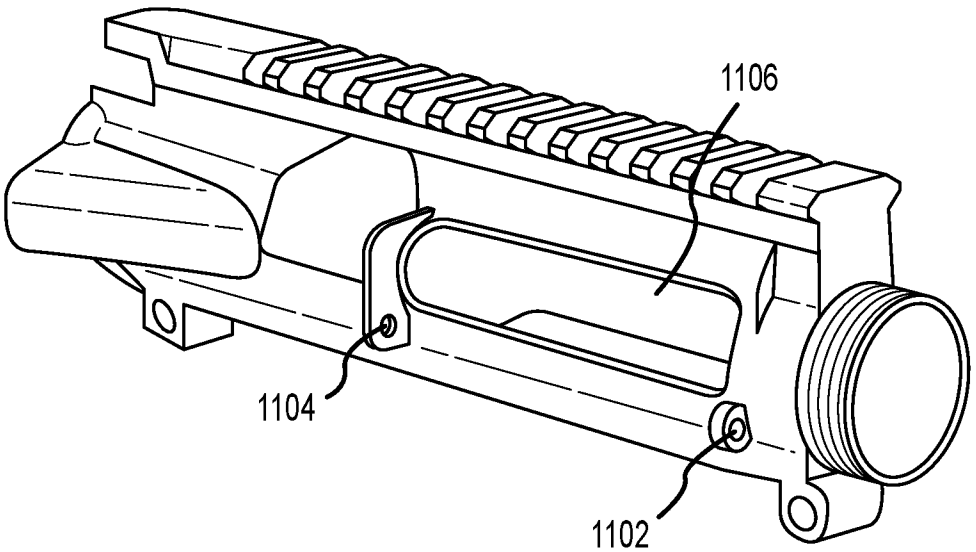
FIG. 11 illustrates a receiver with hinge openings.

The herein disclosed ejection port cover includes a tool-less installation and removal mechanism, as illustrated in an embodiment shown in FIGS. 1-10. In particular, the ejection port cover assembly 100 can include a cover 101 and pins 102, 104 at both ends of the assembly 100 that rotatably seat in mating holes in the receiver. An exemplary receiver 1100 is shown in FIG. 11 with mating holes (or hinge openings) bookending an ejection port 1106. More specially, a first hinge opening 1102 is toward a front of the receiver 1100 and a front end of the ejection port 1106 while a second hinge opening 1104 toward the rear of the receiver 1100 and a rear of the ejection port 1106. FIG. 11 is illustrative only and other receivers can also be used with the herein disclosed ejection port cover of FIGS. 1-10. For instance, any ejection port having first and second hinge openings can be combined with the herein disclosed ejection port cover. Furthermore, while the herein disclosed ejection port cover is shown in a substantially rectangular shape with two rounded corners, other ejection port cover shapes can also be implemented without change to the tool-less tri-function spring.

Figure 2:
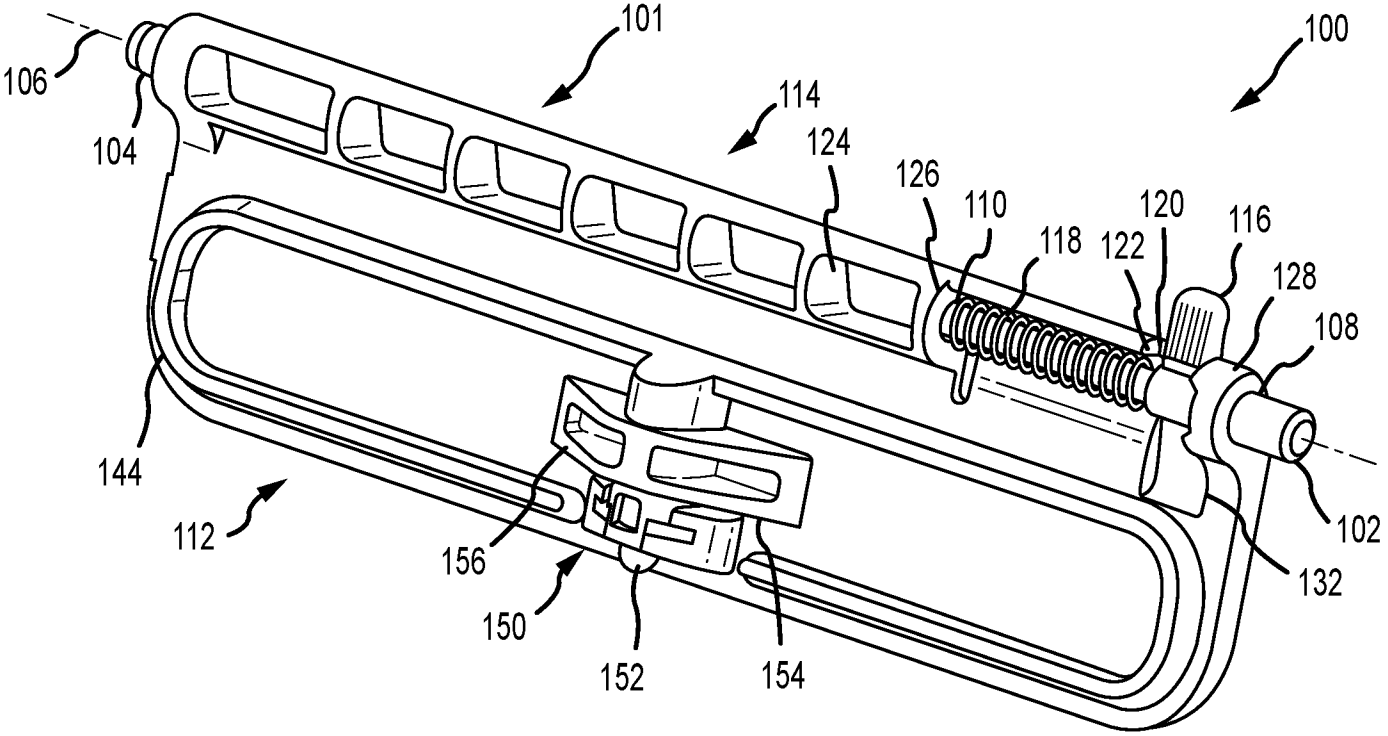
FIG. 2 illustrates an interior of the ejection port cover of FIG. 1.
Figure 5:
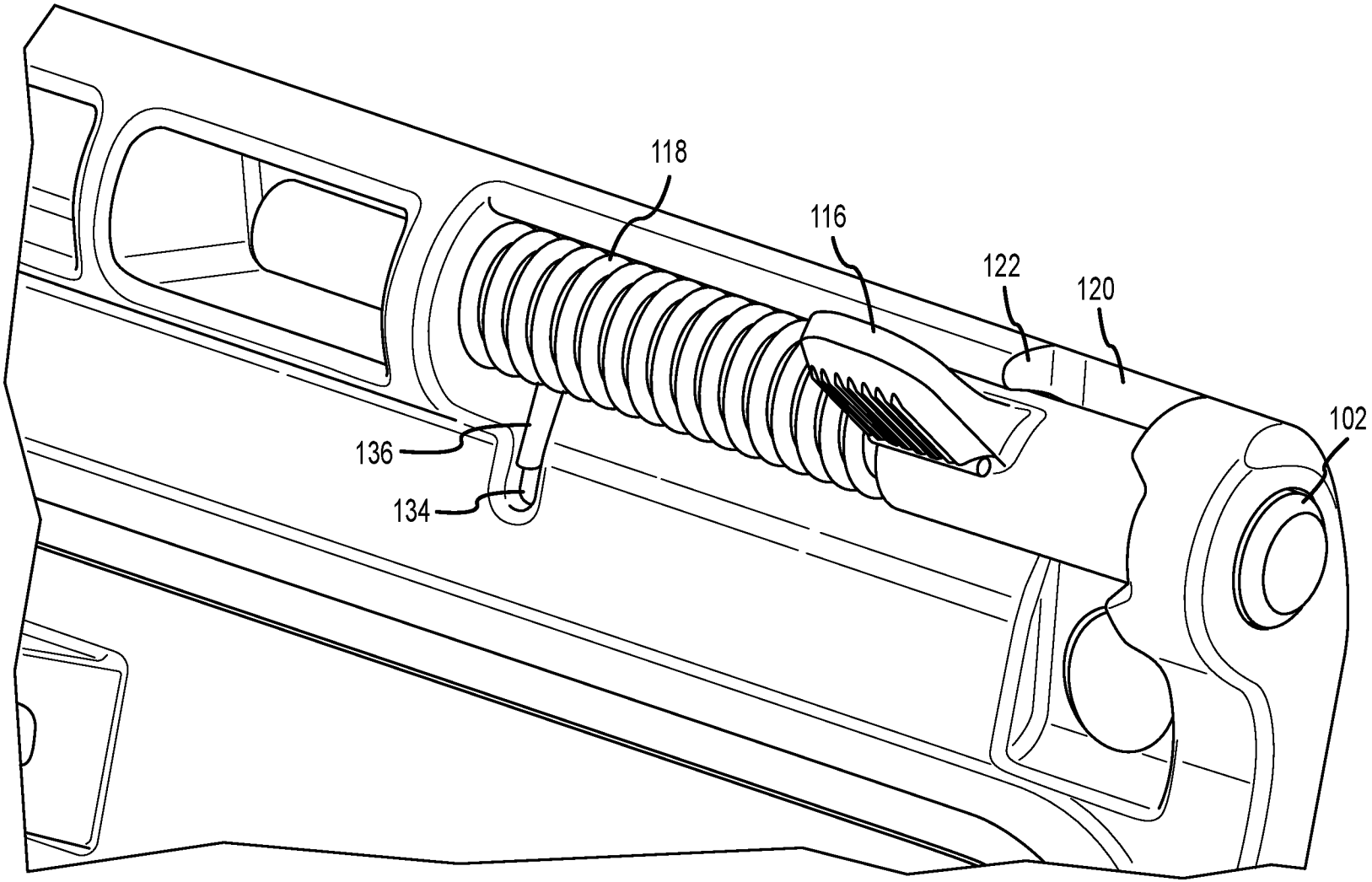
FIG. 5 shows the flag of FIG. 4 being used to compress a spring for removal or insertion of the ejection port cover.
Figure 6:
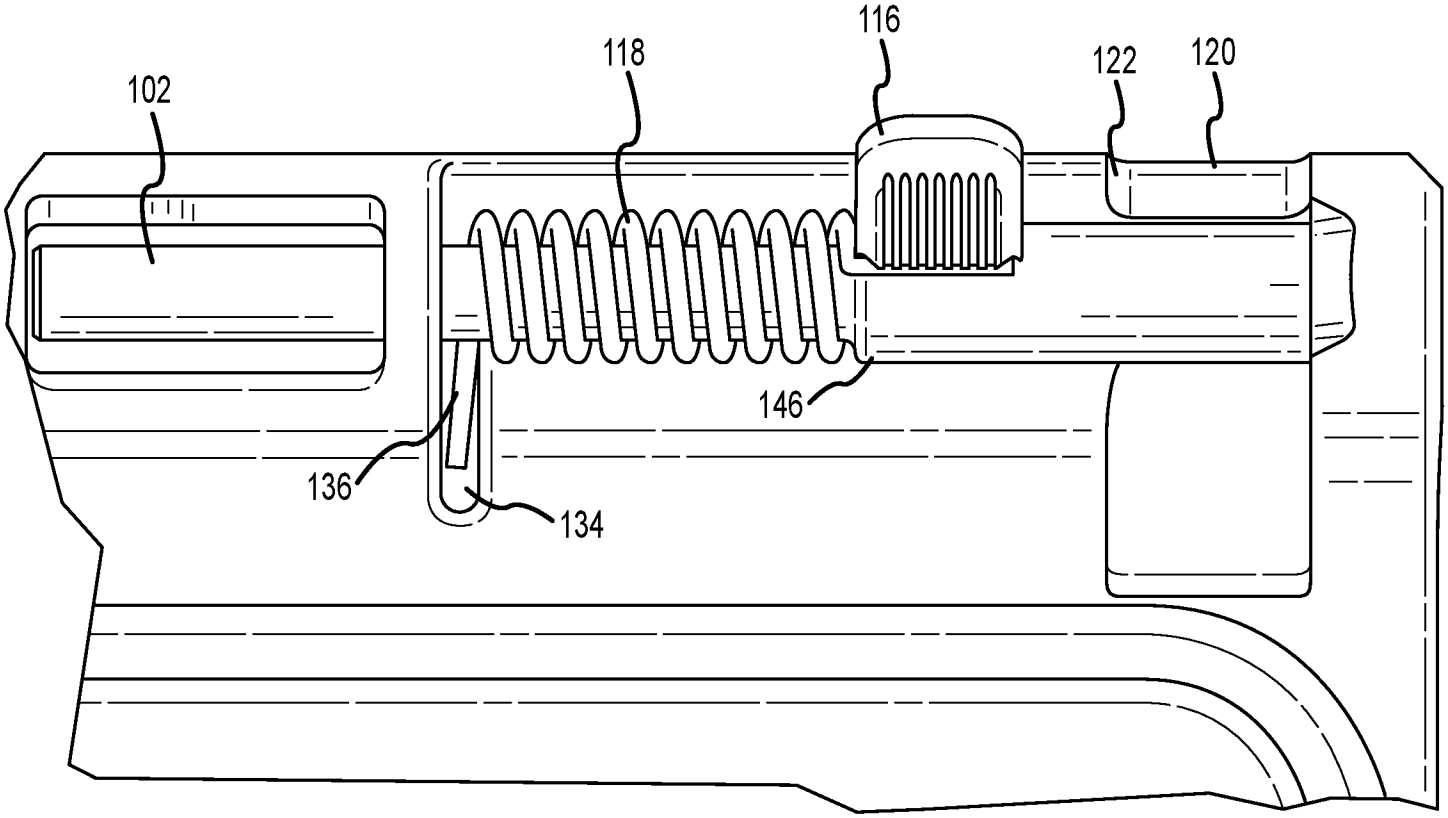
FIG. 6 illustrates a profile view of the flag and spring of FIG. 5.
Figure 7:
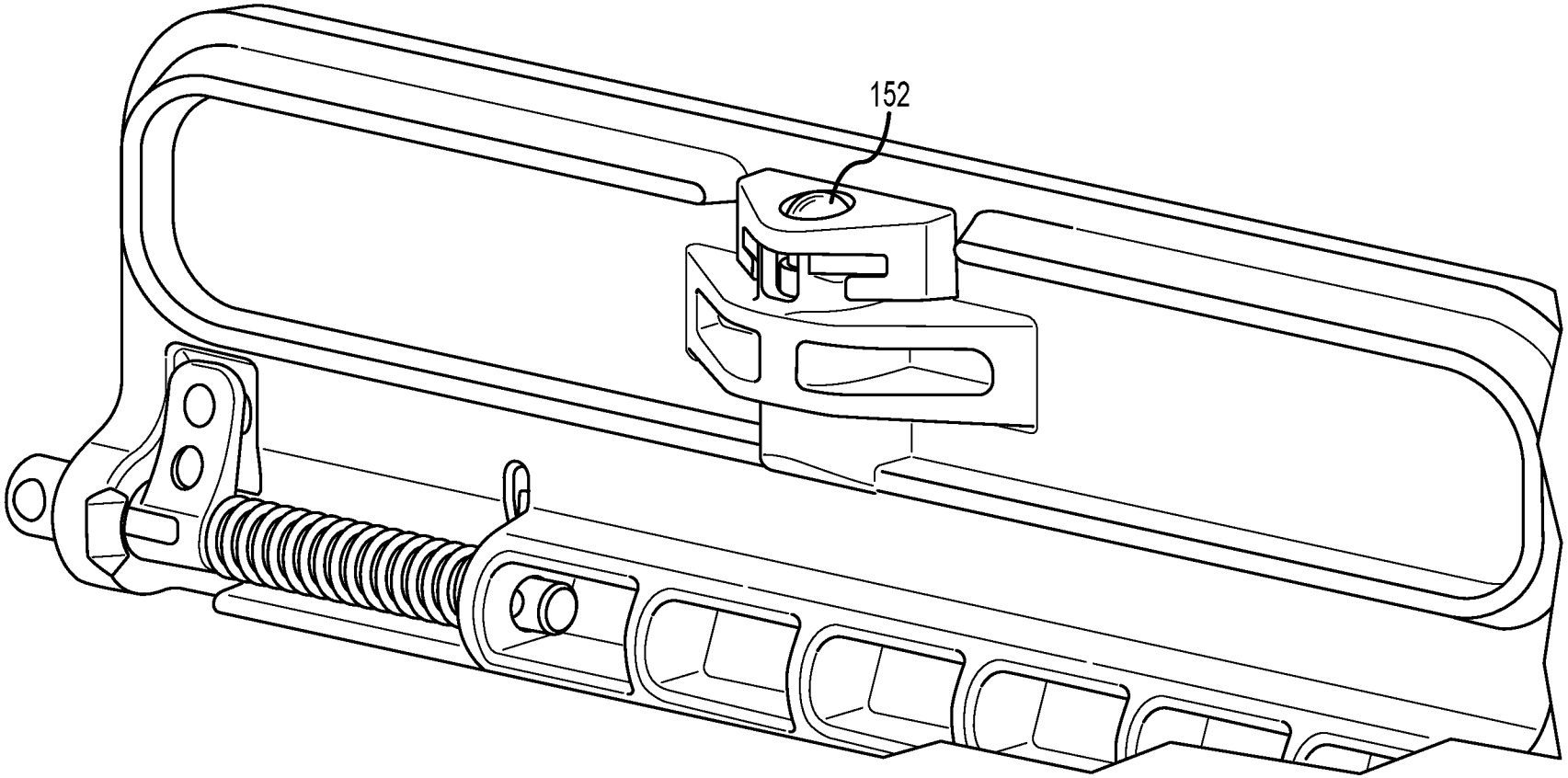
FIG. 7 illustrates an ejection port cover as it would be seen from within a firearm receiver when installed.

FIG. 1 illustrates the ejection port cover assembly 100 in a closed state, while FIG. 2 shows the ejection port cover assembly 100 in an open state. To help with visibility, the flag 116 is rotated into a position where it would be found if the ejection port cover assembly 100 was not attached to a firearm (in other words, this is the default position of the flag 116, when no pressure is applied to the flag 116). In use however, FIG. 7 presents the flag 116 as it would appear when the ejection port cover assembly 100 is affixed to a firearm. As compared to the default and detached position shown in FIGS. 1 and 2, one can see that the flag 116 is rotated about 180 from the default position when installed on a firearm and in the closed position, and this coils the spring 118 to generate an opening force on the ejection port cover 101. Moving between the open and closed positions shown in FIGS. 1, 2, and 7 can occur via rotation about an axis 106 that passes through two pins 102, 104. When affixed to a firearm, these two pins 102, 104 are largely unseen as they fit into hinge openings such as 1102 and 1104 in FIG. 11. The axis 106 is offset from a plane aligned with and coincident with an interior surface 112 of the ejection port cover 101. An outer surface 114 is arranged opposite to the interior surface 112. A first of the two pins can be a spring-loaded pin 102 and a second of the two pins can be a fixed pin 104. While the spring-loaded pin 102 is arranged toward a front of the firearm, in other embodiments, the spring-loaded pin can be arranged toward the rear of the firearm and the fixed pin can be arranged toward the front of the firearm. The spring-loaded pin 102 can be arranged through two apertures 108, 110 on an inside (facing out of the page in FIG. 2) of the ejection port cover 101. The spring-loaded pin 102 is biased by the spring 118 (see FIG. 2) toward an extended position (e.g., see FIG. 2), or toward a front of the firearm, but a user can push the spring-loaded pin 102 rearward and compress the spring 118 such that the spring-loaded pin 102 is withdrawn from and clears a hinge opening in the receiver such that the ejection port cover assembly 100 can be removed or installed. For instance, FIGS. 5 and 6 show close ups of the spring-loaded pin 102 in a rearward position that would allow tool-less removal or installation of the ejection port cover.

The flag 116 may be a unique structure from the spring-loaded pin 102, or may be fixed thereto, or formed as a homogenous unit with the spring-loaded pin 102. As a result, the spring-loaded pin 102 may or may not rotate with rotation of the flag 116. More importantly, is the interfacing between the flag 116 and the spring 118, wherein rotation of the flag 116 causes rotation of part of the spring 118 such that torsional energy is stored in the spring 118. More specifically, one end of the spring 118 can be fixed to the cover, for instance, via a straight portion 136 arranged in an elongated depression 134 (see detail of FIG. 5), and the opposing end can be fixed to the flag 116. When the ejection port cover assembly 100 is attached to a firearm, a backside of the flag 116 (the side going into the page in FIG. 2) presses against the receiver, and as the ejection port cover 101 is rotated from the open position in FIG. 2 toward the closed position in FIG. 1 or 7, the flag 116 remains pressed against the receiver while the spring rotates and stores energy. This energy enables the ejection port cover to quickly rotate open when released from the closed position.

Figure 4:
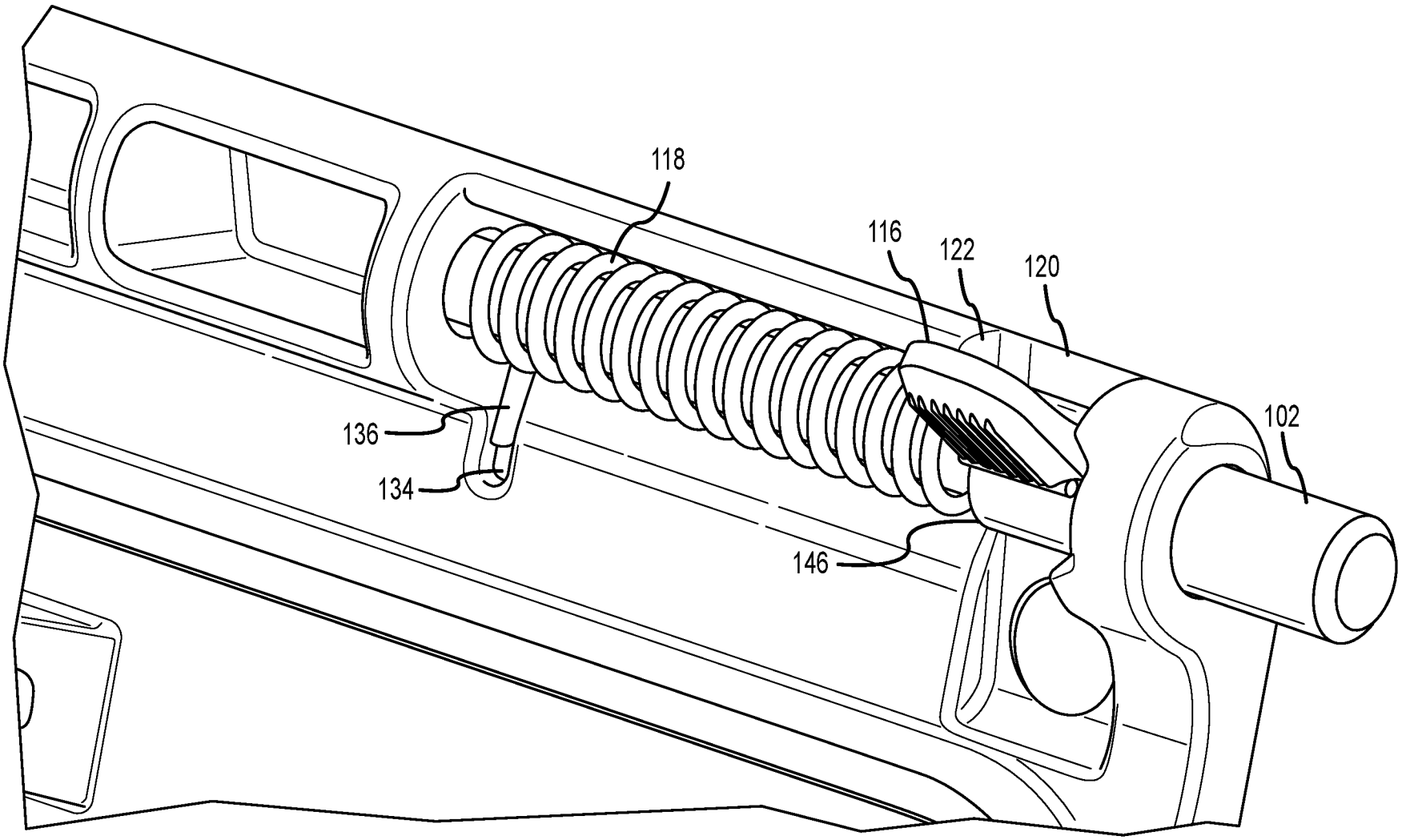
FIG. 4 shows a flag of a spring-loaded pin being rotated.

In the illustrated embodiment, the flag 116 interfaces with the spring 118 to enhance the user's ability to interface with and move the spring-loaded pin 102 toward a rear of the firearm. The flag 116 may be arranged within a notch 120 such that the flag 116 cannot be moved rearward unless the flag 116 is rotated sufficiently to clear a rear edge 122 of the notch 120. This is typically performed while the ejection port assembly 100 is in an open position. The flag's 116 interface with the notch 120 helps prevent accidental removal of the spring-loaded pin 102 when the ejection port cover 101 is in the open position. The spring 118 not only provides a linear bias on the spring-loaded pin 102, but also provides a torsional bias rotating the flag 116 toward a position where it is arranged within the notch 120. In other words, the spring 118 tends to keep the pin 102 in a position where it cannot easily be moved rearward due to the flag's 116 seating within the notch 120. Only via user rotation of the flag 116 against the torsional bias of the spring 118 can the flag 116 be rotated into a position where the user can then pull the flag 116 rearward and disengage the end of the spring-loaded pin 102 from the corresponding hinge opening (e.g., 1102 in FIG. 11) in the receiver. FIG. 4 shows the flag 116 rotated sufficiently to allow rearward movement of the spring-loaded pin 102 as shown in FIG. 5. One can see that the flag 116 has rotated sufficiently to clear the rear edge 122 of the notch 120 and that it could be rotated further while still allowing the pin 102 to be pulled rearward. This linear compression of the spring 118 biases the spring-loaded pin 102 toward a front of the firearm or an extended position, and if the user does not continue to move the flag 116 backward, the spring-loaded pin 102 will move into the extended or forward position where it extends into the corresponding hinge opening in the firearm receiver. In some embodiments, the spring-loaded pin 102 can include a portion near the flag 116 with a wider radius than a portion toward the fixed pin 104. The transition between these two portions 146 can include a sharp edge 146 between the two portions and this edge 146 can interface with the spring 118 and compress the spring 118 when the flag 116 is moved rearward.

In an embodiment, a rib 124 can be arranged as a stop for the spring-loaded pin 102 such that it cannot be excessively moved toward a rear of the firearm and potentially exit the aperture 108. The length of the spring-loaded pin 102 can be such that removal (intentional or unintentional) of the pin 102 from the apertures 108 and 110 is very difficult if not impossible. In other words, the spring-loaded pin 102 can be longer than a gap or dimension between facing surfaces of the rib 124 and the rib 128. Said another way, the length of the spring-loaded pin 102 is such that when the pin 102 is moved fully rearward and impinges on the rib 124, the spring-loaded pin 102 is still long enough to remain at least partially within the aperture 108, and thus unable to be easily removed from the ejection port cover 100. FIG. 4 shows the spring-loaded pin 102 being rotated to a position where it can be moved rearward and FIGS. 5 and 6 show a next step in the removal or installation process, where the spring-loaded pin 102 is moving rearward having cleared the rear edge 122 of the notch 120. In FIG. 6 the spring-loaded pin 102 is in a fully-rearward position with a rear end impinged upon and stopped by the rib 124. As seen, even in this fully-rearward position, a front end of the spring-loaded pin 102 is still inside and mated with the aperture 108, thereby preventing the spring-loaded pin 102 from easily being removed from the ejection port cover assembly 100. As seen, the apertures, 108 and 110, can be arranged within two ribs 128 and 126, respectively, of a plurality of ribs arranged along a length of the ejection port cover assembly 100.

The spring 118 not only biases the pin 102 into an extended position, and biases the flag 116 into a position where the pin 102 cannot be withdrawn, but also biases the ejection port cover 101 toward an open position (e.g., FIG. 1). Traditional ejection port covers also include a torsion spring for this purpose, but do not utilize this spring for the three-way-purpose of (1) biasing the ejection port cover toward an open position, (2) biasing a flag, and also (3) biasing a spring-loaded pin. This disclosure not only allows easier and tool-less installation and removal of the ejection port cover assembly 100, as well as an easy-to-access flag 116 that is restricted from rearward movement until the flag 116 is rotated sufficiently to clear the notch 120, but does so without the addition of a secondary spring. Instead, the same torsion spring that biases the ejection port cover toward the open position during firing, also biases the spring-loaded pin into an extended position and biases the flag into a locked position in the notch. Accordingly, the spring is referred to as a tool-less tri-way spring.

Figure 3:
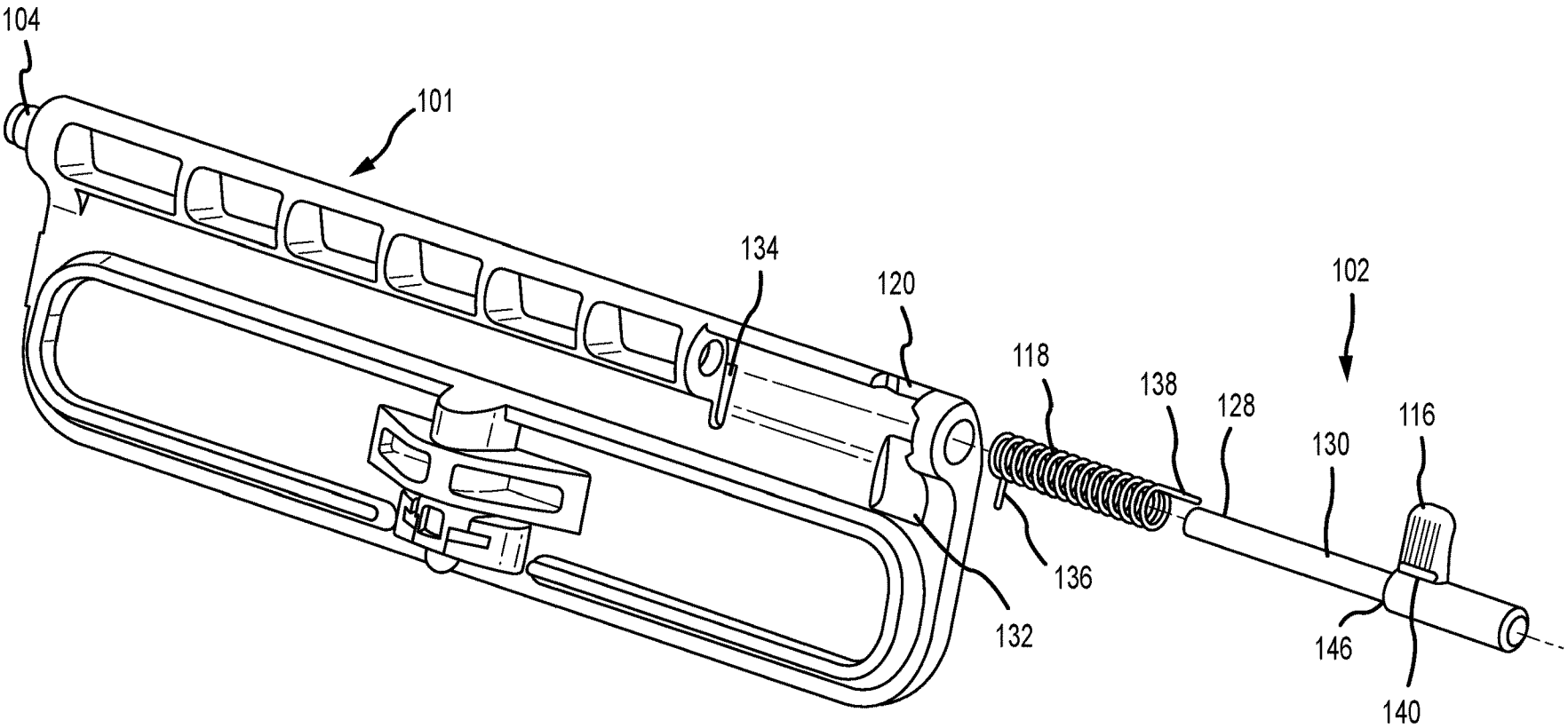
FIG. 3 illustrates an exploded view of the interior of the ejection port cover of FIG. 1.

When the ejection port cover 100 is installed and rotated to a closed position, the flag 116 is pressed against the receiver and winds the spring 118 as the ejection port cover 100 is closed. A flag indentation 132 is arranged adjacent to and rearward of the rib 128, as best seen in FIG. 3. This flag indentation 132 can be shaped like the flag 116 with slightly larger inner dimensions such that the flag 116 can nestle into the flag indentation 132 when the ejection port cover 101 is in a close position. See FIG. 7 for an example of the ejection port cover 100 in the closed position and at least a portion of the flag 116 nestled in the flag indentation 132. The receiver is hidden from view in FIG. 7 to better allow visibility of the ejection port cover assembly 100 components when the ejection port cover 100 is in the closed position. This not only makes for a more compact design, but also creates a natural lock on the flag 116 to prevent the spring-loaded pin 102 from being driven toward a rear of the firearm when the ejection port cover 100 is closed. In other words, the flag indentation 132 prevents rearward movement of the spring-loaded pin 102 and the flag 116 when the ejection port cover 101 is in the closed position, and the notch 120 prevents rearward movement of the spring-loaded pin 102 and the flag 116 when the ejection port cover 101 is in the open position.

The spring 118 has a coiled shape and wraps around a middle section 130 of the pin 102. At a rear end of the spring 118, the spring 118 straightens and extends tangentially from the pin 102 (and perpendicular to a longitudinal axis of the pin 102) and into an elongated depression 134 that holds the straight portion 136 of the spring. This straight portion 136 can be referred to as a first straight portion 136. At the front end of the spring, the spring 118 straightens in a direction roughly parallel to a longitudinal axis of the pin (in practice this second straight 138 section can be slightly angled relative to the longitudinal axis of the pin 102, for instance to help secure the second straight section 138 to the flag 116). The second straight section 138 is seated within a flag notch 140 in a portion of the flag 116 where a base of the flag 116 meets the pin 102. The spring 118 can be arranged entirely on the inside 112 of the cover 100 such that when the cover 100 is closed, the spring 118 is concealed from outside view and hence from dirt and dust and accidental damage from typical field handling (e.g., see AR Overmolded Ultimate Dust Cover by SRIKE INDUSTRIES for an example of an exposed spring). The springs of existing ejection port covers are exposed to the outside when the cover is in the closed or open state.

Figure 8:
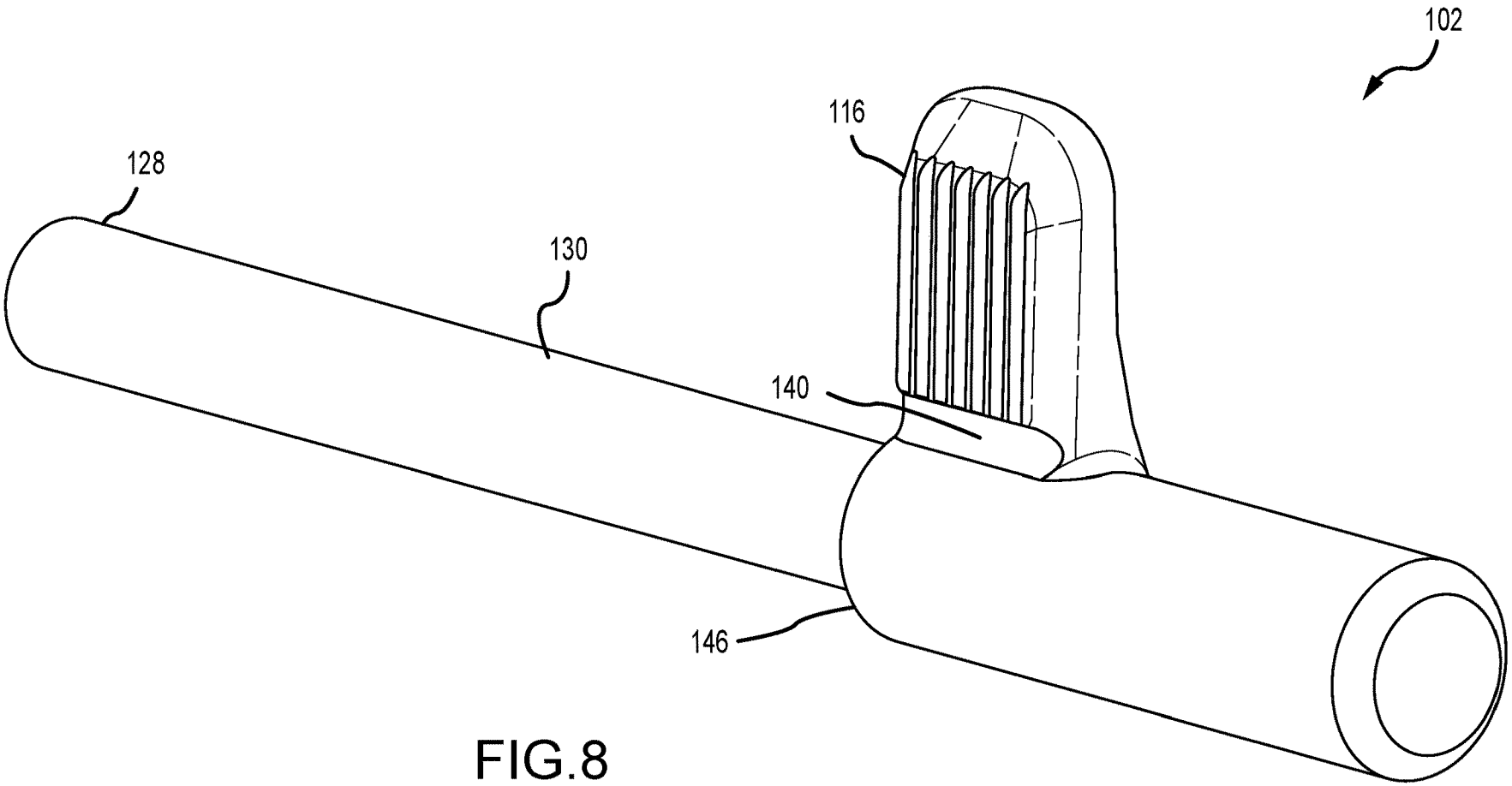
FIG. 8 illustrates details of a spring-loaded pin.
Figure 9:
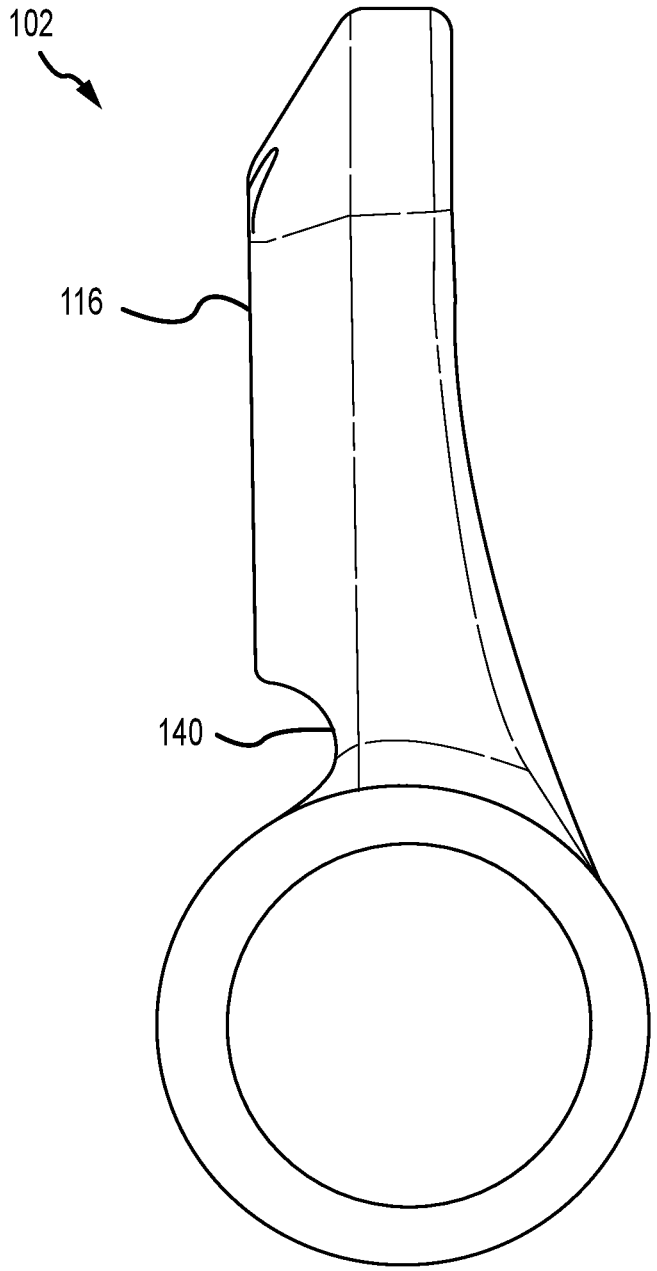
FIG. 9 illustrates an end view of the spring-loaded pin of FIG. 8.
Figure 10:
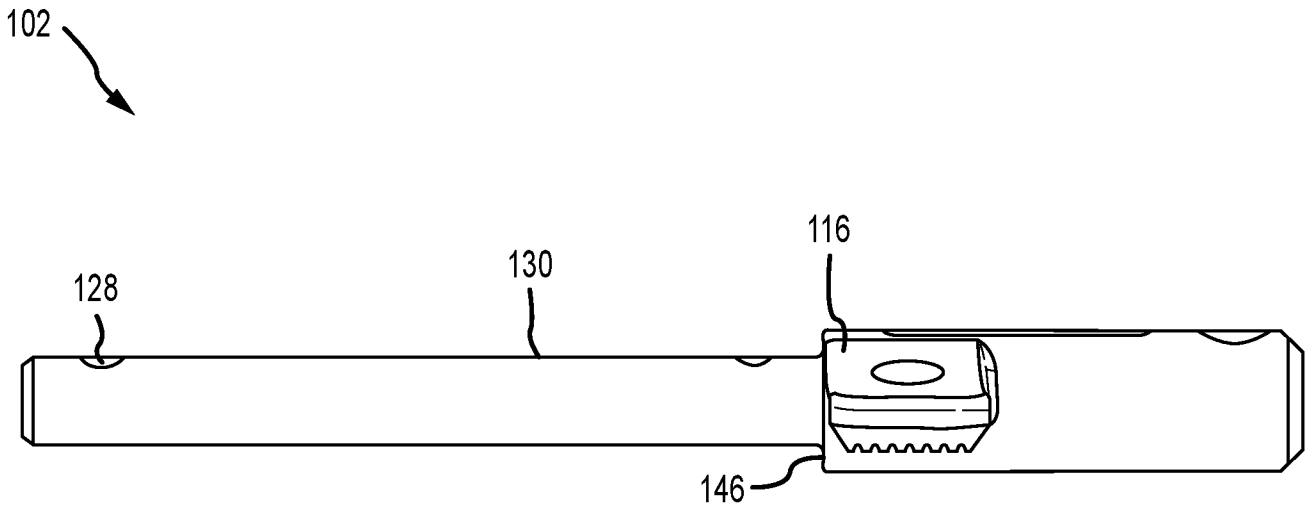
FIG. 10 illustrates a top view of the spring-loaded pin of FIG. 8.

The pin 102 can have two diameters (as best seen in FIGS. 3 and 8): a first smaller diameter stretching from the flag 116 rearward where the spring 118 wraps around the pin 102; and a second larger diameter from the flag 116 forward and including that portion of the pin 102 that enters a corresponding hinge opening (e.g., 1102 in FIG. 11) in the receiver. The flag 116 can be tapered as it extends away from the pin 102 (i.e., a widest portion where the flag 116 meets the pin 102 and a narrowest portion furthest from the pin 102). This tapering is best seen in the side profile view of FIG. 9.

During initial assembly of the ejection port cover 100, when the spring-loaded pin 102 is first assembled into the cover 100, the spring-loaded pin 102 can be elastically bent to allow installation in the ejection port cover 100. This may be needed where the pin 102 is longer than a distance between the two apertures 108, 110, for instance as seen in FIG. 6. However, this elastic deformation is not possible nor intended to be called upon by a consumer.

Figure 12:
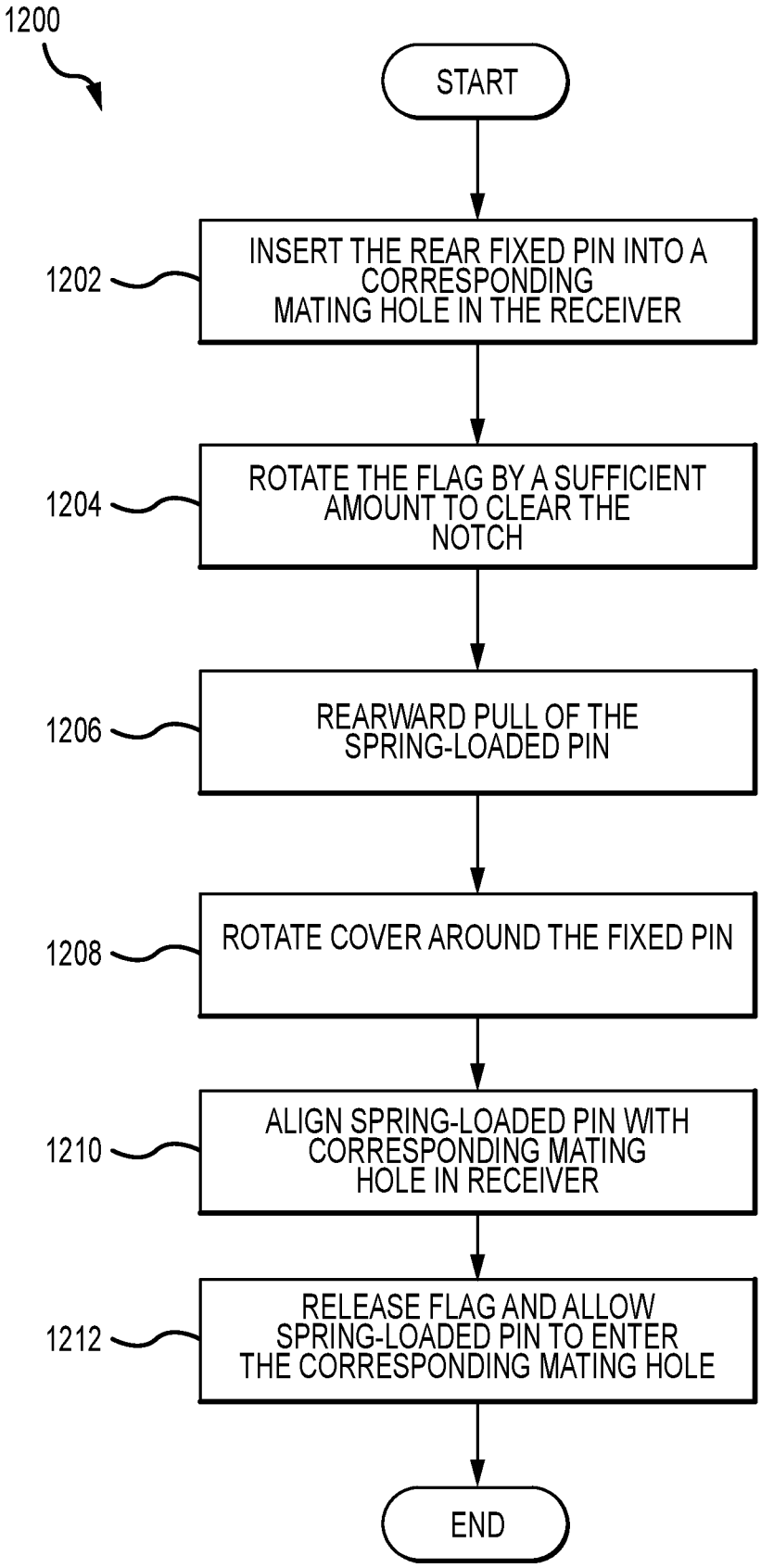
FIG. 12 illustrates a method of tool less installation of an ejection port cover according to an embodiment of this disclosure.

FIG. 12 illustrates a method of installing the ejection port cover onto a firearm. The Installation 1200 involves inserting the rear fixed pin of the ejection port cover (e.g., 104) into a corresponding hinge opening in the receiver (Block 1202). This can be performed before, in parallel, or after, rotation of the flag by a sufficient amount to clear the notch (Block 1204) followed by a rearward pull of the spring-loaded pin (Block 1206). The ejection port cover can then be pivoted, with the fixed pin acting as a focal point of the pivot (Block 1208), and the spring-loaded pin can be aligned with the corresponding hinge opening in the receiver (Block 1210). The user can then release the flag allowing the spring-loaded pin to enter the corresponding hinge opening (Block 1212). The ejection port cover, via a torsional bias from the spring, will naturally move to the open position unless the user presses the cover into the closed position where a ball end plunger can hold the ejection port cover in a closed position.

Figure 13:
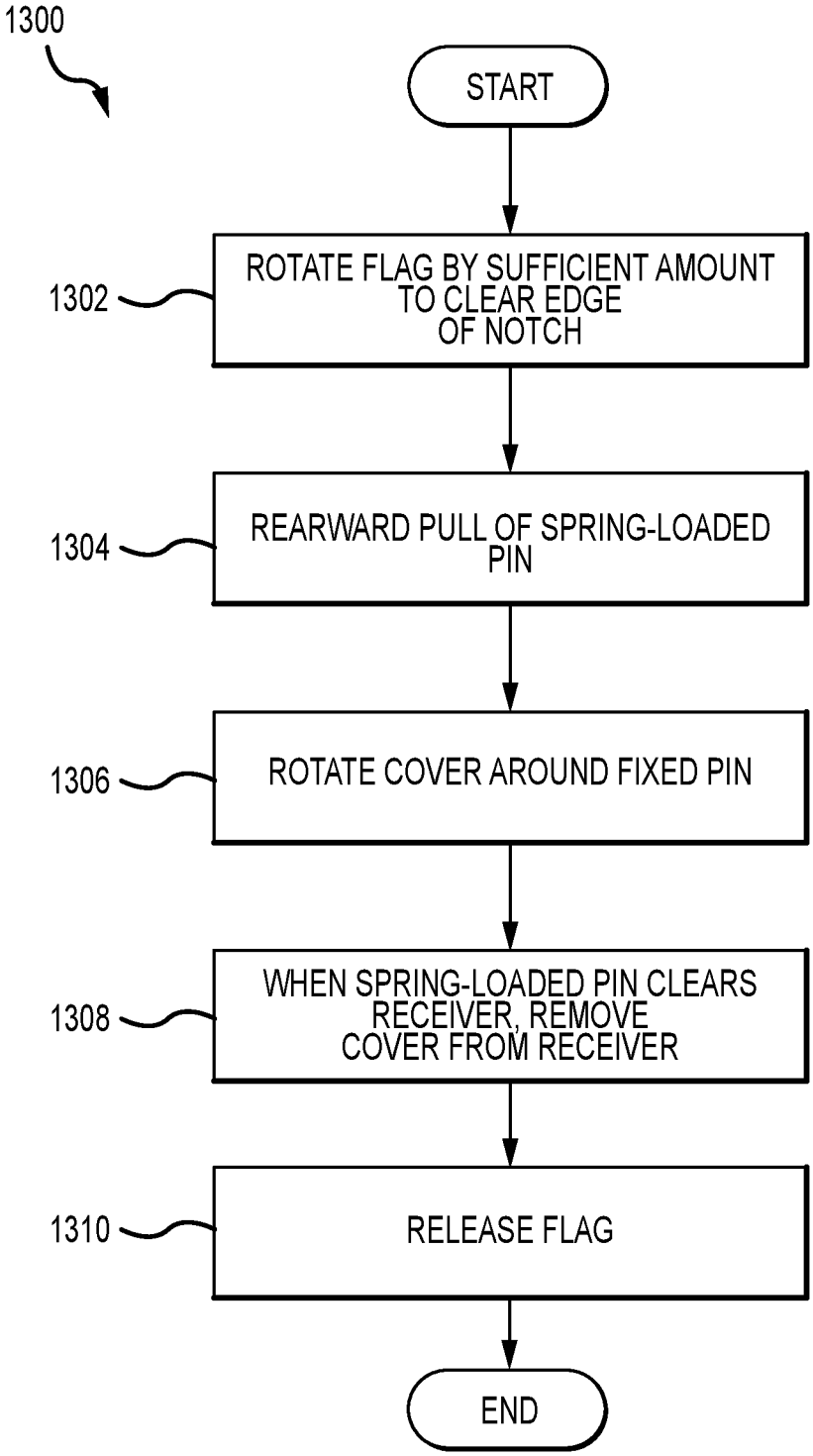
FIG. 13 illustrates a method of tool less removal of an ejection port cover according to an embodiment of this disclosure.

FIG. 13 illustrates a method of removing the ejection port cover from a firearm. Removal 1300 involves rotation of the flag by a sufficient amount to clear the notch (Block 1302) followed by a rearward pull of the spring-loaded pin (Block 1304). The ejection port cover can then be pivoted, with the fixed pin acting as a focal point of the pivoting (Block 1306), until the spring-loaded pin clears the receiver. The fixed pin is then free to be removed with the ejection port cover (Block 1308) and the flag can be released (Block 1310).

The herein disclosed ejection port cover is primarily composed of polymer, which provides the typical benefits of reduced weight and resistance to corrosion. However, a unique benefit in this application is that the ejection port cover tends to break before it deforms to the point of not functioning correctly (e.g., failing to seal the port or interfering with movement of the bolt). This makes it easy to identify when a part has failed and needs to be replaced. This is especially important when the temptation for a weapon owner or an armorer is to bend a metal cover back into a "functional" state instead of outright replacing it. This can create substandard performance similar to when an aluminum magazine is "repaired" in such a manner.

Lip

The ejection port cover can include an ovular lip 144 on an inside surface 112 that fits snugly within the ejection port of the firearm thereby minimizing liquid, debris, dirt and other particles and objects entering the receiver and chamber of the firearm. Use of a polymer for the ejection port cover means that this lip 144 can be formed with tighter tolerance to the dimensions of the firearm's ejection port. This is because the lip 144 will not cause metal-on-metal interfacing with the ejection port and can therefore be molded to have a tighter fit to the ejection port (i.e., rubbing is less problematic with a polymer lip 144 than a metal one). Additionally, the polymer is more malleable than metal, and via deformation can form a tighter seal with the ejection port than traditional metal ejection port covers. For instance, the ovular lip 144 could be dimensioned to match or oven overlap the ejection port such that some deformation of the ovular lip 144 occurs when the ejection port cover 100 is closed.

Cover Lock

A cover lock assembly 150 can be arranged at least partially within the circumference of the lip 144 and may even interrupt a continuous path of the lip 144. The cover lock assembly 150, like the lip 144, can be arranged on an interior surface 112 of the ejection port cover 100. The cover lock assembly 150 can include a ball-end plunger detent 152 configured to selectively mate with a locking indent on the receiver when the ejection port cover 100 is closed thereby securing the ejection port 100 in a closed state despite the bias of the spring 118. The cover lock assembly 150 can be disassembled by a consumer without specialized tools. The cover lock assembly 150 also includes a forward-facing ramp 154 and a rearward-facing ramp 156 arranged on opposing sides of the detent 152. These ramps 154, 156 are arranged and angled such that movement of the firearm's bolt carrier group across either ramp 154, 156 will back drive the detent 152 and open the ejection port cover 100 when the weapon is operated. In other words, when the ejection port cover 100 is closed, the cover lock assembly 150 protrudes inward toward a center of the chamber and bolt such that when the bolt is racked it impinges one of these two ramps 154, 156 and puts enough torque on the ejection port cover 100 to back drive the detent 152 (see depressed detent 152 in FIG. 7) and allow the detent 152 to disengage from the locking detent in the receiver. This in turn allows the spring 118 to rotate the ejection port cover 100 from the closed position to the open position thereby allowing the discharge of spent cartridges during firing.

The detent 152 can be manufactured from steel or another material having greater impact and flex resistance than polymers. Some known detents are formed from a polymer, but see rapid degradation as the polymer detent rubs against the hard-anodized aluminum upper receiver (e.g., the POLY-FLEX Dust Cover sold by STRIKE INDUSTRIES).

The terms and expressions employed herein are used as terms and expressions of description and not of limitation, and there is no intention, in the use of such terms and expressions, of excluding any equivalents of the features shown and described or portions thereof. Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a "protrusion" should be understood to encompass disclosure of the act of "protruding"—whether explicitly discussed or not—and, conversely, were there only disclosure of the act of "protruding", such a disclosure should be understood to encompass disclosure of a "protrusion". Such changes and alternative terms are to be understood to be explicitly included in the description.

As will be appreciated by one skilled in the art, aspects of the present disclosure may be embodied as an apparatus, assembly, and/or method. As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed:

1. An ejection port cover assembly comprising:

an ejection port cover;

a first pin configured to rotate within a first hinge opening of a firearm receiver portion;

a spring;

a second pin configured to be spring-loaded by the spring, and to rotate within and selectively engage with a second hinge opening of the firearm receiver portion; and a user interface surface extending radially outward from the second pin;

wherein the spring is configured to apply a torsional bias to the user interface surface and to bias the second pin away from the first pin along a common axis, and wherein when installed on the firearm receiver portion, the spring in combination with the user interface surface biases the ejection port cover toward an open position.

2. The ejection port cover assembly of claim 1, further comprising a lip arranged on an inside of the ejection port cover and shaped and sized to create a tight seal with an ejection port of the firearm when the ejection port cover is closed.

3. The ejection port cover assembly of claim 2, further comprising a detent for locking the ejection port cover in a closed position, and wherein the ejection port cover is primarily formed of polymer and the detent is metal.

4. The ejection port cover assembly of claim 2, wherein the lip is formed of a polymer and is configured to deformably seal with the ejection port.

5. The ejection port cover assembly of claim 1, wherein the spring is coupled to the user interface surface and an inside of the ejection port cover.

6. The ejection port cover assembly of claim 1, wherein the spring biases the second pin into the selective engagement with the second hinge opening.

7. A firearm comprising:

a receiver portion comprising:

an ejection port;

a first hinge opening at a first end of the ejection port;

a second hinge opening at a second end of the ejection port; and an ejection port cover comprising:

a first pin selectively mated with the first hinge opening;

a spring;

a second pin configured to be spring-loaded by the spring and selectively mated with the second hinge opening, wherein the second pin is configured for removal from the second hinge opening while the first pin is still mated with the first hinge opening, thereby enabling tool-less removal of the ejection port cover from the receiver portion; and a flag extending from the second pin and configured to bias the ejection port cover toward an open position.

8. The firearm of claim 7, wherein the spring is configured to bias the second pin into the second hinge opening.

9. The firearm of claim 7, wherein the spring wraps around a portion of the second pin, and is not exposed to the outside of the firearm when the ejection port cover is in a closed position.

10. The firearm of claim 7, wherein the spring is wrapped around the second pin, coupled to a flag of the second pin, and coupled to the ejection port cover, such that the spring biases the ejection port cover toward an open position, biases the second pin into engagement with the second hinge opening, and biases the flag toward an open position.

11. The firearm of claim 7, wherein the second pin further comprises a flag biased against the receiver portion, when the ejection port is in a closed position, thereby coiling the spring.

12. The firearm of claim 11, wherein the spring is coupled to the flag such that rotation or translation of the flag correspondingly coils or compresses the spring.

13. The firearm of claim 7, wherein the flag and the spring engage to provide a torsional bias to the ejection port cover.

14. The firearm of claim 7, wherein the ejection port cover further comprises a lip extending into the ejection port to form a seal with the receiver portion.

15. The firearm of claim 14, wherein the lip is formed of a polymer and deformably seals with the ejection port.

16. A firearm ejection port assembly cover comprising:

an ejection port cover;

a first pin configured for selective mating with a first hinge opening of a firearm receiver portion;

a spring;

a second pin configured to be spring-loaded by the spring, and configured for selective mating with a second hinge opening of the firearm receiver portion, wherein the second pin is configured for removal from the second hinge opening while the fixed pin is mated with the first hinge opening, thereby enabling tool-less removal of the ejection port cover from the firearm receiver portion;

a pin extension from the second pin engaged with the spring and configured to (1) bias the ejection port cover into an open position and (2) be used in removing the second pin from the second hinge opening.

17. The firearm ejection port assembly cover of claim 16, wherein the spring is configured to bias the second pin into the second hinge opening.

18. The firearm ejection port assembly cover of claim 16, wherein the spring wraps around a portion of the second pin, and is not exposed to the outside of a firearm when the ejection port cover is in a closed position.

19. The firearm ejection port assembly cover of claim 16, wherein the spring is wrapped around the second pin, engaged with a notch in the ejection port cover, and engaged with a notch in the pin extension.

20. The firearm ejection port assembly cover of claim 16, wherein the ejection port cover further comprises a lip extending into an ejection port to form a seal with the receiver portion.

21. The firearm ejection port assembly cover of claim 20, wherein the lip is formed of a polymer and deformably seals with the ejection port.

* * * * *